US007412182B2

(12) United States Patent
Hayashi et al.

(10) Patent No.: US 7,412,182 B2
(45) Date of Patent: Aug. 12, 2008

(54) IMAGE FORMING APPARATUS WITH SETTING OF AN OPERATING CONDITION OF AT LEAST ONE IMAGE HEATING DEVICE

(75) Inventors: Yasuhiro Hayashi, Moriya (JP); Hiroto Nishihara, Toride (JP); Naoto Watanabe, Kashiwa (JP); Yukio Yokoyama, Sakado (JP); Takako Hanada, Yokohama (JP); Kuniyasu Kimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/014,315

(22) Filed: Jan. 15, 2008

(65) Prior Publication Data

US 2008/0118267 A1 May 22, 2008

Related U.S. Application Data

(62) Division of application No. 11/256,936, filed on Oct. 25, 2005.

(30) Foreign Application Priority Data

Oct. 25, 2004 (JP) ..... 2004-309554

(51) Int. Cl.
*G03G 15/20* (2006.01)

(52) U.S. Cl. ..... 399/70

(58) Field of Classification Search ..... 399/67–70, 399/320–342

See application file for complete search history.

(56) References Cited

U.S. PATENT DOCUMENTS

| | | | | |
|---|---|---|---|---|
| 5,241,349 | A | 8/1993 | Nagasaka | 355/285 |
| 6,278,852 | B1 | 8/2001 | Hayashi | 399/88 |
| 6,349,187 | B2 | 2/2002 | Hayashi | 399/70 |

(Continued)

FOREIGN PATENT DOCUMENTS

CN 1445617 A 10/2003

(Continued)

OTHER PUBLICATIONS

Official Letter/Search Report issued by the European Patent Office on Sep. 9, 2007, in European Patent Application No. 07013730.2.

(Continued)

*Primary Examiner*—Ryan Gleitz
(74) *Attorney, Agent, or Firm*—Fitzpatrick, Cella, Harper & Scinto

(57) ABSTRACT

An image forming system has an image forming device, a first image heating device for heating a toner image at a first nip to maintain a target temperature, a second image heating device for heating a toner image at a second nip to maintain a target temperature, a selecting device for selecting a first image forming mode in which only the first image heating device is used for a image heating process and a second image forming mode in which the first image heating device and the second image heating device are used for the image heating process, and a delaying device for making timing at which the target temperature of the first image heating device is lowered in a stand by state later than a timing at which the target temperature of the second image heating device is lowered in the stand by state.

4 Claims, 11 Drawing Sheets

U.S. PATENT DOCUMENTS

| | | | | |
|---|---|---|---|---|
| 6,795,661 | B2 | 9/2004 | Kanesawa et al. | 399/69 |
| 6,987,251 | B2 | 1/2006 | Fukushi et al. | 219/619 |
| 7,030,345 | B2 | 4/2006 | Nishihara et al. | 219/619 |
| 2002/0191992 | A1 | 12/2002 | Funato | |
| 2003/0180063 | A1 | 9/2003 | Kanesawa et al. | 399/69 |
| 2005/0031364 | A1 | 2/2005 | Hayashi | 399/69 |
| 2005/0271408 | A1 | 12/2005 | Hayashi | 399/70 |
| 2006/0131301 | A1 | 6/2006 | Ohta et al. | 219/619 |
| 2006/0157475 | A1 | 7/2006 | Nishihara et al. | 219/619 |
| 2006/0227205 | A1 | 10/2006 | Nishihara et al. | 347/194 |

FOREIGN PATENT DOCUMENTS

| | | | |
|---|---|---|---|
| EP | 0 917 008 | A2 | 5/1999 |
| EP | 0 987 605 | A2 | 3/2000 |
| JP | 1-100583 | | 4/1989 |
| JP | 5-323710 | | 12/1993 |
| JP | 10-207287 | | 8/1998 |
| JP | 2000-221821 | | 8/2000 |
| JP | 2001-42673 | | 2/2001 |
| JP | 2002-49258 | | 2/2002 |
| JP | 2002-365967 | | 12/2002 |
| JP | 2003-162200 | | 6/2003 |
| JP | 2003-270991 | | 9/2003 |
| JP | 2004-246040 | | 9/2004 |

OTHER PUBLICATIONS

Official Action/Search Report, issued on Apr. 18, 2008, by the European Patent Office, in Application No. 05023323.8.

Official Action/Search Report, issued on Dec. 28, 2007, by the Chinese Patent Office, in Chinese Application No. 2005101160189.

IMAGE FORMING APPARATUS WITH SETTING OF AN OPERATING CONDITION OF AT LEAST ONE IMAGE HEATING DEVICE

This application is a divisional of U.S. patent application Ser. No. 11/256,936, filed Oct. 25, 2005, now pending.

FIELD OF THE INVENTION AND RELATED ART

The present invention relates to an image forming apparatus such as a copying machine, a printer, a facsimile machine or the like wherein an image is formed through an electrophotographic process or an electrostatic recording process, and also to an image forming method therefor.

A number of types of full-color image forming apparatus such as a printer, a copying machine or the like using an electrophotographic process. Recently, the full-color image forming apparatus is required to have the capability of forming an image on various recording materials and to have the capability of high speed image formation with high image quality. To meet the requirement for the usability with various types of recording materials, an image fixing device is desirably capable of applying optimum amount of heat to the recording material and to the toner. By such application of heat, the fixing strength is assured, and a preferable image glossiness is provided.

When, for example, a thick recording material is used, a larger amount of heat is required to melt and fix a toner image on the recording material than an usual recording material since such a recording material has a relatively larger thermal capacity.

For this reason, when the recording material is thick, the fixing temperature is set high, or the fixing speed is lowered to increase the fixing time period.

In the former case, however, if the image is formed on coated paper having a relatively low air permeability with a too high temperature, the water contained in the coated paper evaporates at once with the result of unsmoothness of the surface of the coated paper, and therefore, disturbance of the image. In addition, thermal deterioration of the fixing member or the parts therearound is accelerated, and therefore, it is ordinary to use the latter method (lowering of the fixing speed).

Japanese Laid-open Patent Application 2002-49258 and Japanese Laid-open Patent Application 2000-221821 propose image forming apparatus wherein the use is made with a plurality of fixing devices to apply heat to the toner and to the recording material a plurality of times corresponding to the number of the fixing devices so that various recording materials are usable without lowering the fixing speed, that is, at a high speed.

Particularly, in Japanese Laid-open Patent Application 2000-221821, the number of the fixing devices to be used is changed depending on the types of the recording material.

However, for the user who uses only the recording materials that require operation of only one of fixing devices, the electric power is wasted by keeping the other fixing device or devices in a stand-by state.

In addition, said other fixing device or devices are in the heated state despite the fact that they are not used, the device is thermally deteriorated gradually with the result of shortening of the service life.

SUMMARY OF THE INVENTION

Accordingly, it is a principal object of the present invention to provide an image forming apparatus and an image forming method wherein an operating condition of image heating means can be manually set.

It is another object of the present invention to provide an image forming apparatus and an image forming method wherein a lifetime of image heating means which is less frequently used can be extended.

It is a further object of the present invention to provide an image forming apparatus and an image forming method wherein electric power consumed by image heating means which is less frequently used can be saved.

It is a further object of the present invention to provide an image forming apparatus and an image forming method wherein the electric power consumption can be saved.

These and other objects, features, and advantages of the present invention will become more apparent upon consideration of the following

DESCRIPTION OF THE PREFERRED EMBODIMENTS

The preferred embodiments of the present invention will be described in conjunction with the accompanying drawings. The present invention is not limited to these embodiments.

Embodiment 1

Figure 11:
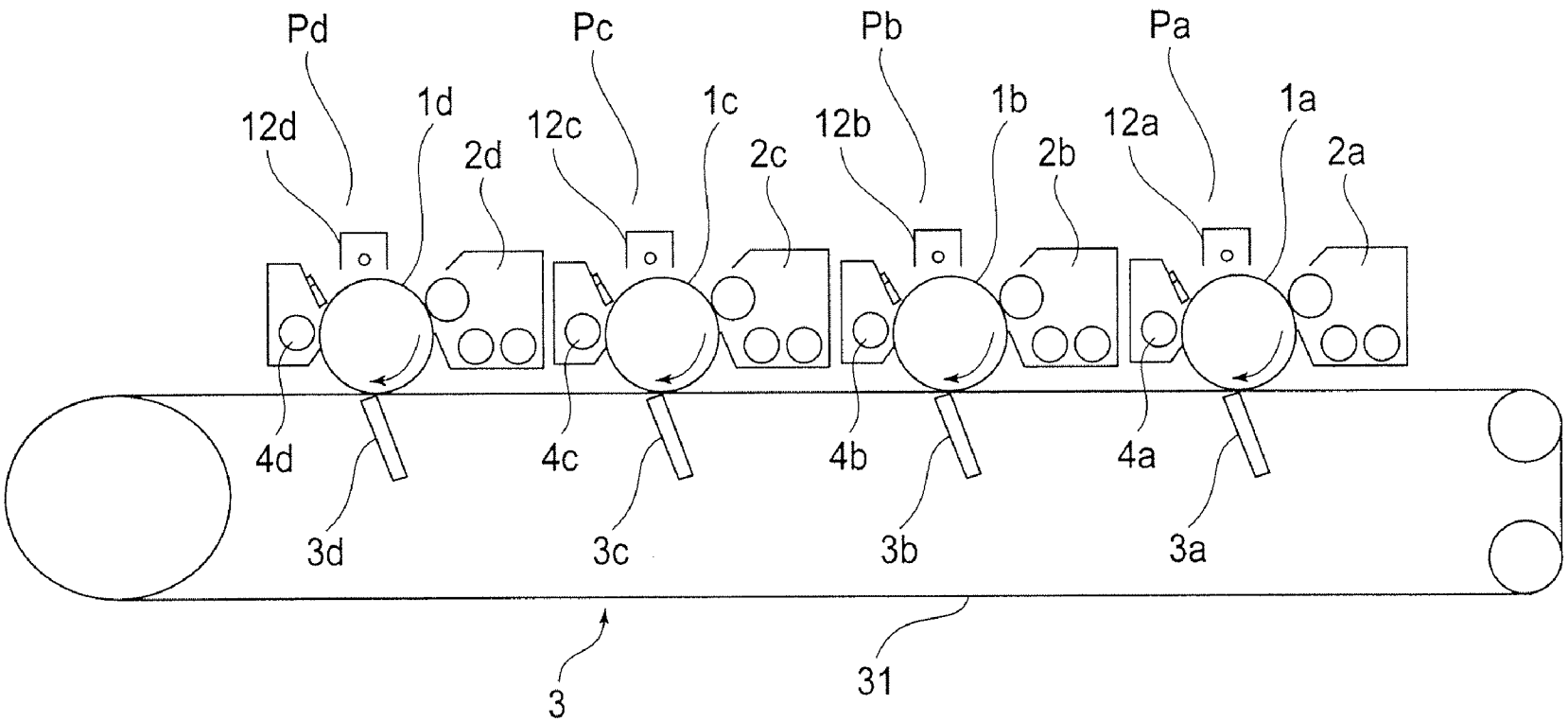
FIG. 11 is a schematic sectional view of a major part of an image forming apparatus.

Referring first to FIG. 11, there is shown a schematic sectional view of a major part of an image forming apparatus employing an electrophotographic process.

The image forming apparatus comprises four image forming stations Pa, Pb, Pc, Pd (image forming means) as shown in this Figure.

Figure 4:
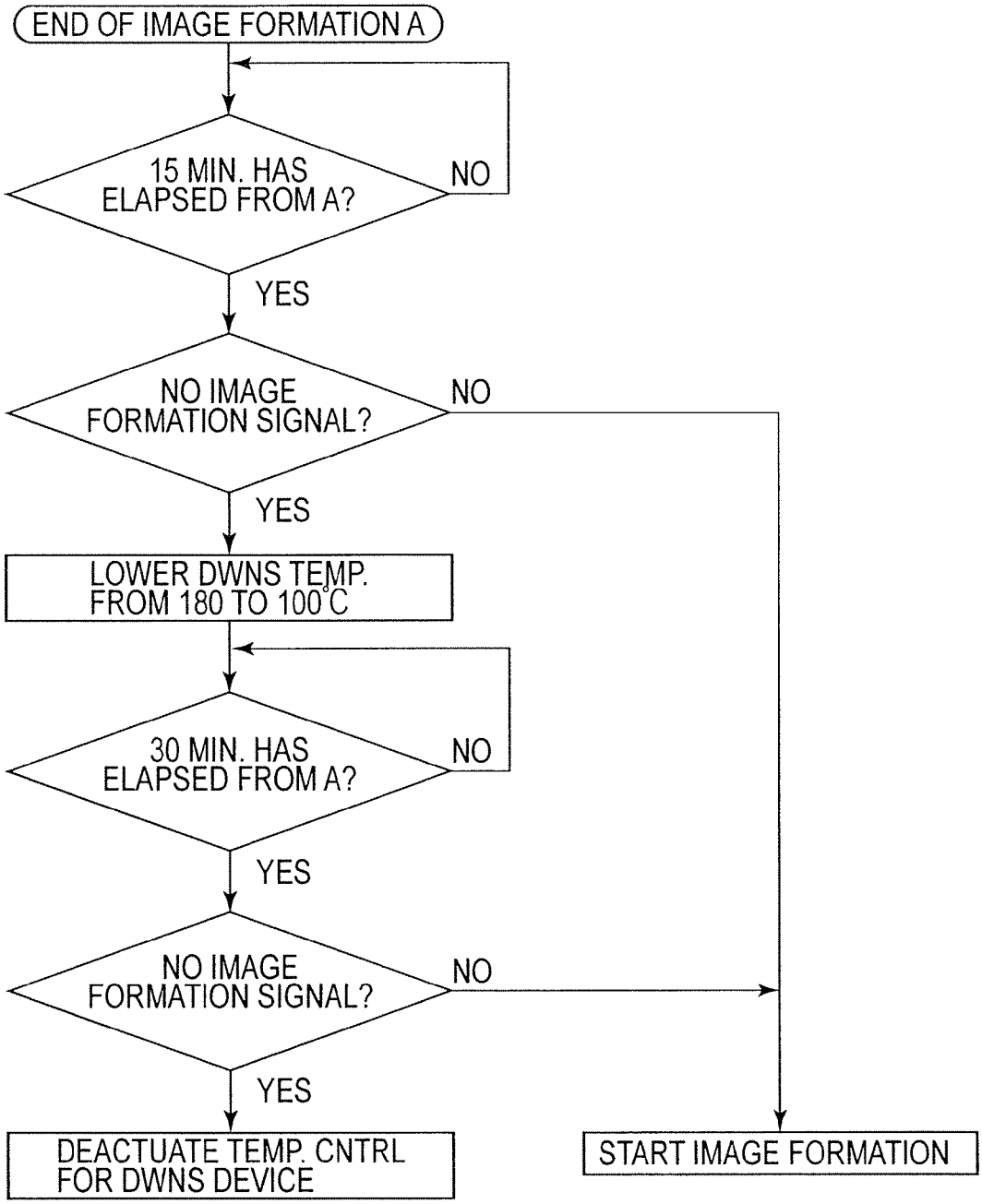
FIG. 4 is a flow chart illustrating a control sequence after completion of the image formation.

The image forming stations Pa, Pb, Pc, Pd function to form magenta, cyan, yellow and black images, respectively, and they have respective photosensitive drums 1*a*, 1*b*, 1*c*, 1*d* (image bearing members) rotatable in the direction of an arrow in FIG. 4.

Around the respective photosensitive drums 1*a*, 1*b*, 1*c*, 1*d*, there are provided chargers 12*a*, 12*b*, 12*c*, 12*d*, developing devices 2*a*, 2*b*, 2*c*, 2*d*, and cleaner 4*a*, 4*b*, 4*c*, 4*d*, as process means, in the order named in the direction of rotation of the associated photosensitive drums 1*a*, 1*b*, 1*c*, 1*d*.

Below the respective photosensitive drums 1*a*, 1*b*, 1*c*, 1*d*, there are provided transfer stations 3. The transfer stations 3 include chargers 3*a*, 3*b*, 3*c*, 3*d*, and a common transfer belt 31 (recording material feeding means) is provided.

Toner images are formed on the respective photosensitive drums in timed relation with a recording material P supplied from an unshown sheet feeding cassette and carried on the transfer belt 31. The toner images of respective colors are superimposedly transferred onto the recording material P on the transfer belt 31.

Upon completion of the transfer step, the recording material P is separated from the transfer belt 31 and is fed to a fixing device A.

The unfixed toner image transferred onto the recording material P is fixed on the recording material P by the fixing device A and is discharged to an outside of the apparatus.

The recording material P are sheet materials such as plain paper, coated paper, transparent film or the like, on which the image is formed.

Figure 1:
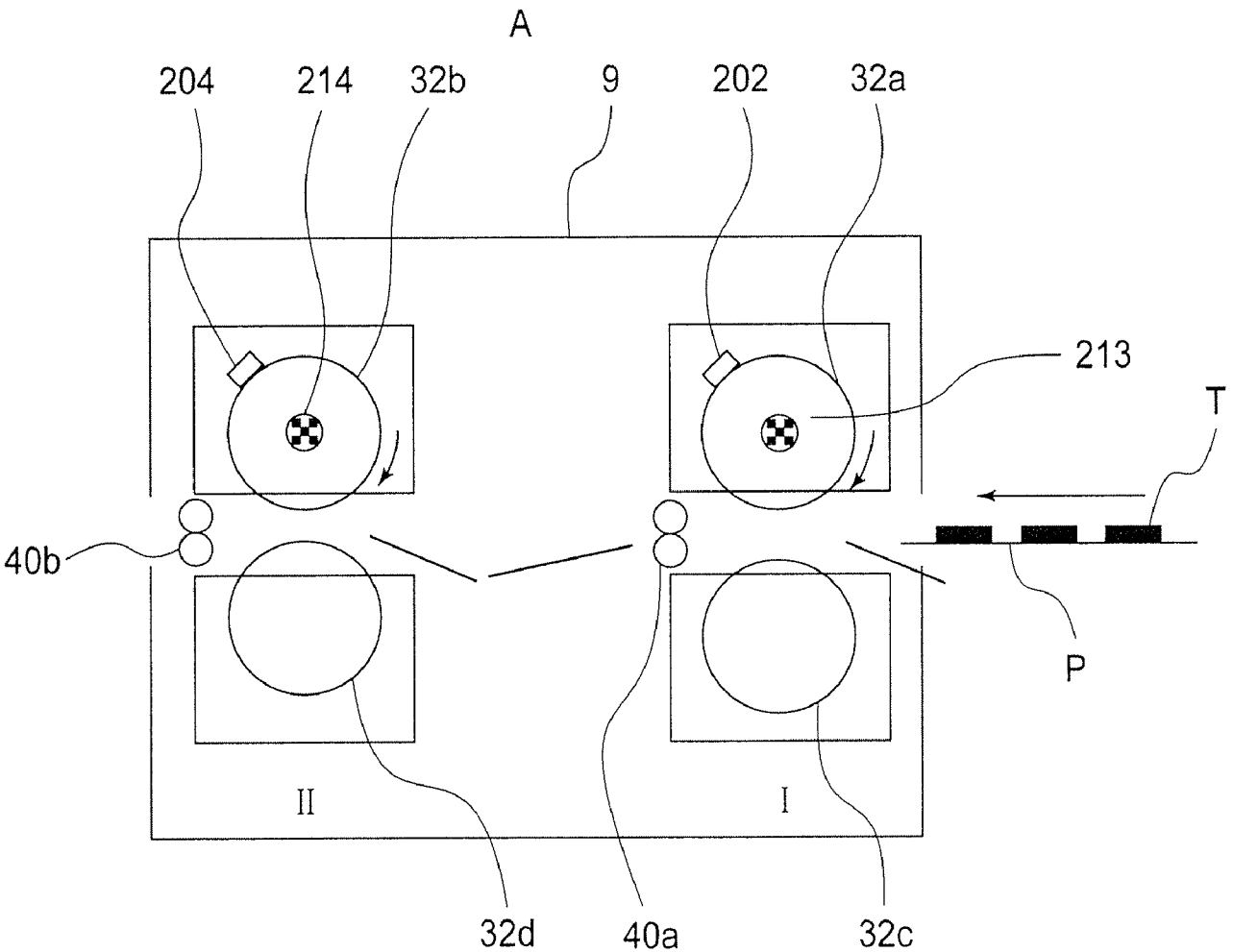
FIG. 1 is a sectional view of an image fixing device.

Referring now to FIG. 1, there is shown a schematic view of the fixing device A (image heating apparatus) used in the image forming apparatus.

As shown in the Figure, the fixing device A comprises a frame 9, in which a fixing device I and a fixing device II are provided as image heating means. Fixing device II is disposed at a position downstream of the fixing device I with respect to the feeding direction of the recording material P.

The description will first be made as to the fixing device I (first image heating means) which is disposed upstream.

The upstream fixing device I has a fixing roller 32*a* (heating element) and a pressing roller 32*c* (pressing member). The fixing roller 32*a* is contacted to an unfixed toner image T on the recording material P to fix the image on the recording material P.

The fixing roller 32*a* includes a cylindrical core metal of aluminum having an outer diameter of 46 mm and a thickness of 3 mm, a silicone rubber layer of 2 mm thick (JIS-A 10° in hardness) on the outer periphery of the core metal, and a surface parting layer of 50 μm thick (PFA tube). The outer diameter of the fixing roller 32*a* constituted by these components is approx. 50 mm. The pressing roller 32*c* may have a similar structure as the fixing roller 32*a*.

The relative position between the fixing roller 32*a* and the pressing roller 32*c* may be a pressing position (fixing position) and a separate position (stand-by position). FIG. 1 shows a separate position. In the pressing position, the roller are pressed against each other with a total pressure of 100 kgf (980N) by a known pressing method using a spring or the like not shown.

By the pressure, the press-contact portion (nip) between the fixing roller 32*a* and the pressing roller 32*c* has a width of approx. 10 mm (nip width) measured in the feeding direction of the sheet. A fixing speed of the fixing device I is 200 mm/sec, and therefore, 40 sheets of A4 size can be fixed per 1 min.

The time required for shifting from the separate position to the pressing position or shifting from the pressing position to the separate position is 0.5 sec. The details of the operation will be described hereinafter.

Inside the fixing roller 32*a*, there is provided a halogen heater 213 (thermister) of 700 W.

A temperature sensor 202 (thermister) as a temperature detecting means is contacted to the surface of the fixing roller 32*a* to sense the surface temperature of the fixing roller 32*a*.

The surface temperature of the fixing roller 32*a* is controlled by rendering on and off the electric power supply to the halogen heater 213 by a controller 200 (FIG. 2) in response to the output signal of the temperature sensor 202 (thermister) so as to maintain a predetermined target temperature. The recording material P fixed in the nip is fed to the downstream side of the fixing device I by sheet discharging rollers 40*a*.

The description will be made as to the fixing device II (second image heating means) disposed downstream.

The downstream fixing device II includes a fixing roller 32*b* as a heating element and a pressing roller 32*d* as a pressing member. The fixing roller 32 b includes a cylindrical core metal of aluminum having an outer diameter of 46 mm and a thickness of 3 mm, a silicone rubber layer of 2 mm thick (JIS-A 10° in hardness) on the outer periphery of the core metal, and a surface parting layer of 50 _Em thick (PFA tube). The outer diameter of the fixing roller 32*b* constituted by these components is approx. 50 mm.

This fixing roller is the same as the fixing roller 32*a* of the upstream fixing device I in the embodiment, but may be a different one. The pressing roller 32*d* may be the same as the fixing roller 32*b*.

The relative position between the fixing roller 32 *b* and the pressing roller 32 *d* may be a pressing position (fixing position) and a separate position (stand-by position). FIG. 1 shows a separate position.

In the pressing position, the roller are pressed against each other with a total pressure of 100 kgf (980N) by a known pressing method using a spring or the like not shown. By the pressure, the press-contact portion (nip) between the fixing roller 32 *b* and the pressing roller 32 *d* has a width of approx. 10 mm (nip width) measured in the feeding direction of the sheet.

A fixing speed of the fixing device II is 200 mm/sec, and therefore, 40 sheets of A4 size can be fixed per 1 min. The time required for shifting from the separate position to the pressing position or shifting from the pressing position to the separate position is 0.5 sec. The details of the operation will be described hereinafter.

Inside the fixing roller 32*a*, there is provided a halogen heater 214 of 500 W. A temperature sensor 204 (thermister) as a temperature detecting means is contacted to the surface of the fixing roller 32 *b* to sense the surface temperature of the fixing roller 32 b.

The surface temperature of the fixing roller 32 b is controlled by rendering on and off the electric power supply to the halogen heater 214 by a controller 200 (FIG. 2) in response to the output signal of the temperature sensor 204 (thermister) so as to maintain a predetermined target temperature.

The recording material P fixed in the nip is fed and discharged to the outside of the apparatus.

The distance between the feeding roller 40*a* of the fixing device I and the feeding roller 40*b* of the fixing device II is 140 mm which is shorter than a minimum (in the feeding direction) processible recording material, such as a post card, for example. Therefore, even if the fixing roller 32*b* and the pressing roller 32*d* of the fixing device II are in the separate position, the recording material P can be fed to the downstream by the feeding roller 40*a* and the feeding roller 40*b* after the recording material P is subjected to the fixing device I.

Figure 2:
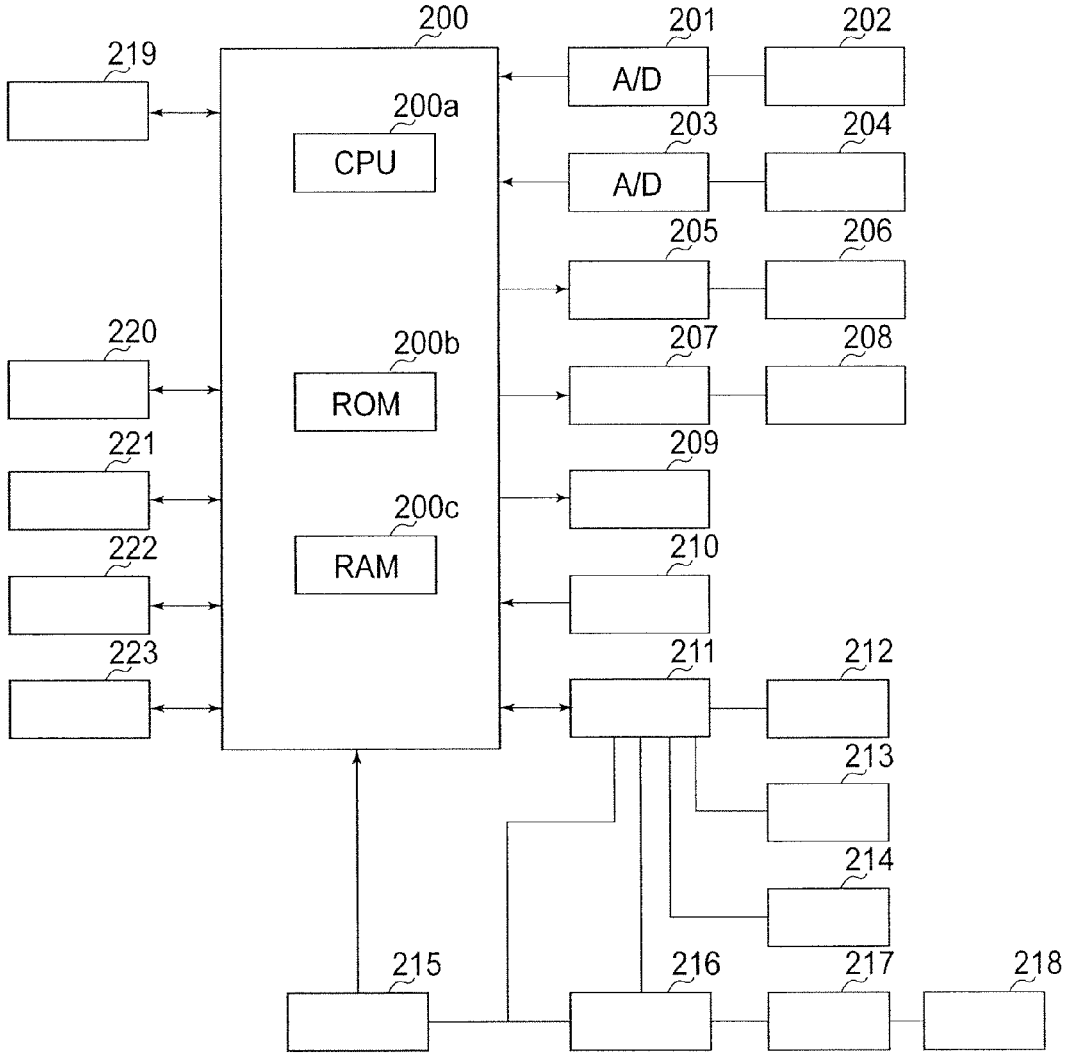
FIG. 2 illustrates a control system for an image forming apparatus.

FIG. 2 is a block diagram illustrating an example of a control system of the image forming apparatus according to an embodiment of the present invention. In this Figure, designated by reference numeral 200 is a controller which comprises a CPU 200*a*, a ROM 200*b*, a RAM 200*c* and so on, and it controls the entirety of the copying sequence in accordance with the program stored in the ROM 200*b*.

The operating portion 219 includes a display portion for manual selection of a copying mode, copy start or the like.

More particularly, the operating portion 219 has a key input portion which includes a copying mode setting key, a copy number setting key, a copying operation start key, a copying operation stop key, a fixing electric power saving key (energy saving key) for adjusting the electric power supply amount to the fixing roller 32*b*, a reset key for resetting the operation mode to the standard mode, and the like and a display portion including a LED lamps and/or liquid crystal display for displaying the set states of operation mode or the like.

The thermister 202 detects the surface temperature of the fixing roller 32*a*, and the detected temperature is converted by an A/D converter 201, and the converted data is inputted to the controller 200. The controller 200 controls the heater to keep the surface temperature of the fixing device 32*a* at a predetermined level using the detected value of the thermister 202. Similarly, the thermister 204 detects the surface temperature of the fixing roller 32*b*, which is A/D-converted by an A/D converter 203 and then is inputted to the controller 200. The controller 200 controls so as to provide a predetermined surface temperature of the fixing roller 32*b* using the detected value of the thermister 202.

The high voltage portion 205 controls a high voltage unit 206 for applying a predetermined voltage to charging systems such as a primary charger, transfer charger or the like and to the developing device or the like, shown in FIG. 11.

The motor controller 207 functions to control the driving of the stepping motor 208 or the like.

A DC load controller 209 controls the operations of a solenoid for a recording material feeding path switching guides 1050 and 1150 (FIG. 10), the respective photosensitive drums, fixing rollers 32*a* 32*b* and a fan or the like.

Designated by 210 is sensors for jam detection of the recording material, and the output signals are inputted to the controller 200.

An AC driver 211 controls the AC load 212 of the laser beam source or the like for image exposure and the AC voltage supply to the fixing heaters 213, 214. An AC driver 211 functions to render a main switch 216 having a shut-off function OFF when an abnormality of the laser beam source for the image exposure, the fixing heater or the like is detected.

A DC voltage source 215 supplies the DC voltage to the controller or the like, and the AC voltage supplied from the voltage source plug 218 is supplied to the DC voltage source 215 through the door switch 217 and the main switch 216.

A sheet feeding deck 220 is a sheet feeding apparatus for stacking a large number of recording materials and is installed optionally.

The editor 221 functions to input position information such as trimming, masking process or the like, and is optionally connected.

A feeder 222 functions to automatically set a plurality of originals, and is connected optionally.

A sorter 223 functions to sort the discharged recording materials, and is optionally connected.

Figure 3:
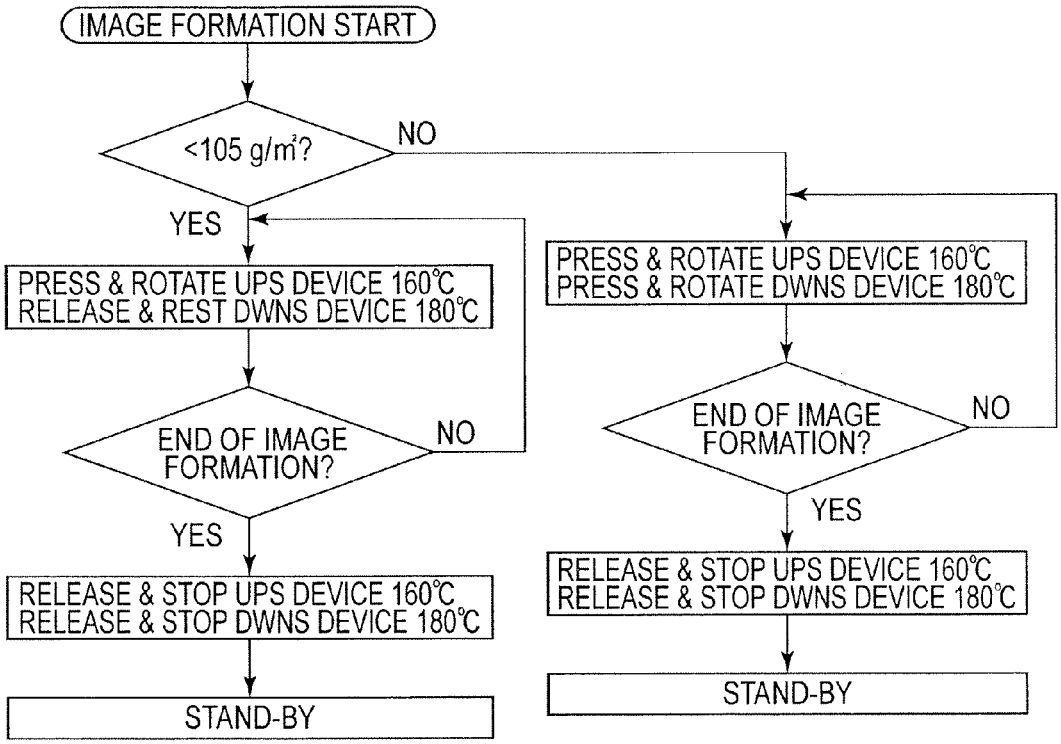
FIG. 3 is a flow chart illustrating a control sequence corresponding to a kind of the recording material.

Referring to FIG. 3 showing a flow chart, the fixing operation responsive to the kind of the recording material will be described.

When the image formation is made on plain paper having a basis weight of less than 105 g/m$^2$ (first image formation mode), only the fixing device I is used for the fixing operation.

In this case, simultaneously with start of the image formation, the fixing roller 32*a* and the pressing roller 32*c* of the fixing device I are pressed against each other, and are rotated. Simultaneously, the feeding roller 40*a* and the feeding roller 40*b* start rotation.

The target temperature of the fixing roller 32*a* is 160° C., with which the toner image can be satisfactorily fixed on plain paper having the basis weight of less than 105 g/m$^2$.

The recording material having passed through the feeding roller 40*a* passes between the fixing roller 32*b* and the pressing roller 32*d* of the fixing device II which are kept apart from each other, without contact thereto, and is fed to the outside of the apparatus by the feeding rollers 40*b*. The glossiness of the image measure in the 60° method is approx. 15.

The target temperature of the fixing roller 32*b* of the fixing device II is 180° C., and it is controlled to keep the temperature although the fixing roller 32*b* and the pressing roller 32*d* are spaced apart from each other.

When the fixing operation is completed, the rotations of the fixing roller 32*a*, the pressing roller 32*c*, the fixing roller 32*b* and the pressing roller 32*d* are stopped, and the fixing roller 32*a* and the pressing roller 32*c* of the fixing device I are spaced apart from each other. In the stand-by state, the fixing roller 32*b* and the pressing roller 32*d* of the fixing device II are spaced apart from each other.

When, on the other hand, an image formation is carried out on plain paper having a basis weight not less than 105 g/m$^2$ (second image formation mode), both of the fixing device I and the fixing device II are used.

In this case, simultaneously with start of the image formation, the fixing roller 32*a* and the pressing roller 32*c* of the fixing device I are pressed against each other, and start rotating, and also, the fixing roller 32*b* and the pressing roller 32*d* of the fixing device II are pressed against each other, and start rotating. Simultaneously, the feeding roller 40*a* and the feeding roller 40*b* start rotation.

The target temperature of the fixing roller 32*a* is 160° C. which is the same as with the case of the plain paper having the basis weight of less than 105 g/m$^2$. Under the fixing condition, the toner image is half-fixed on the recording material. However, the fixing strength at this time is enough to prevent removal of the toner from the recording material during feeding by the feeding roller 40*a* and enough to prevent toner offset to the fixing roller 32*a*. Therefore, the glossiness of the image is low, and the image is still not complete.

After the incomplete image fixing by the fixing device I, the recording material is guided into the nip of the fixing device II by the feeding roller 40*a* and is subjected to the second image fixing.

The target temperature of the fixing roller 32*b* is 180° C. In the second image fixing operation by the fixing device II, the fixing strength becomes sufficiently high to raise the glossiness of the image, thus providing a satisfactory image quality.

The glossiness of the image immediately after the fixing operation of the fixing device I, is only approx. 5 in the 60° method, but is as high as approx. 15 after the fixing operation by the fixing device II.

The recording material is fed to outside the apparatus by the feeding roller 40*b* when the recording material passes through the nip of the fixing device II.

Upon completion of the series of the fixing operations, the rotations of the fixing rollers, and the pressing rollers are stopped, and the fixing roller 32*a* and the pressing roller 32*c* of the fixing device I are spaced from each other, and the fixing roller 32*b* and the pressing roller 32*d* of the fixing device II are spaced from each other, thus restoring the stand-by state.

As described, when the image formation is carried out on the recording material having a basis weight not less than 105 g/m$^2$, the heat quantity escaped into the recording material is large, and therefore, the recording material feeding speed (fixing speed) of the fixing device has to be lower than in the first image formation mode, in some cases, heretofore. However, according to this embodiment, the image formation is possible without the necessity of lowering the fixing speed, since the two fixing devices are used.

The description will be made as to the case of image formation on coated paper which is coated with resin material.

The fixing condition is similar to the case of the second image formation mode for image formation on the recording material having a basis weight not less than 105 g/m$^2$.

In the case that image formation is carried out on the coated paper having a high air permeability (not less than 2000 sec, for example), the target temperature of the fixing device I is lower than in the above-described image formation mode (approx. 140° C., for example) in order to prevent image defect which may occur by the water vapor produced in the recording material burst out through the coating layer.

When the image is fixed by the fixing device II, the image has already been half-fixed by the fixing device I, the water content in the recording material has been reduced, and therefore, the defect does not easily appear. For this reason, the target temperature may 180° C. which is the same as in the above-described image formation mode.

In the foregoing embodiment, the temperature control of the fixing device II is kept (180° C.) always, even in the image formation mode not using the fixing device II.

This is done in order to keep the operable state for image formation irrespective of the kind of the recording material supplied by the user of the image forming apparatus.

In this embodiment, the time required by reaching the operable state from the actuation of the voltage source of the fixing device is approx. 4 min. In the case of the fixing device I, and is approx. 6 min. In the case of the fixing device II.

However, if the user frequently operates the image formation on the recording materials having a basis weight less than 105 g/m$^2$, it is wasteful to keep the temperature control of the fixing device II. That is, the temperature control consumes the electric power wastefully, and thermal deterioration in various parts of the fixing device II is promoted.

In order to avoid such waste, in this example, a switch is provided to control the fixing devices, respectively. The switch is provided on the operation panel (display portion) in the operating portion. The switch may be provided adjacent the associated fixing device. Or, both may be provided.

When the image forming apparatus is used as a printer, the fixing devices may be selectively operable by a host computer (PC) connected with the printer via network cable (LAN).

The selectable modes by the switch is whether the stand-by temperature control is carried out for the fixing devices I and II or not, and whether the electric power supply to the fixing device II are stopped or not. When the stand-by temperature control is carried out, it is possible to raise or lower the target temperature of the fixing roller.

In this example, the description will be made as to the case in which the operation panel has the switch for setting and selecting the stand-by operation of the fixing device II (the operation when the image formation instructions to the image forming apparatus is not produced, and is awaited).

The operation panel is placed at the position for the user's convenience. The switch on the operation panel can select one out of three states, namely, 180° C., 100° C. and off state of the target temperature of the fixing device II during the stand-by state.

Normally, the fixing roller 32*b* of the fixing device II is kept at 180° C. during the fixing operation, and requires approx. 3 min. To restore from 100° C. to 180° C., and requires 6 min. At the maximum to restore from off-state to 180° C.

For the user using various kinds of recording materials such as thick sheets, coated paper or the like, king the target temperature of the fixing device II at 180° C. during the stand-by state is convenient.

On the other hand, for the user using only the recording materials having a basis weight less than 105 g/m$^2$, shutting off the electric power supply to the fixing device II is advantageous. As compared with keeping the temperature, the electric power consumed by the entirety of the fixing device during the stand-by state can be reduced by approx. 60%.

For the user using the thick sheets and coated paper less frequently, keeping the target temperature at 100° C. during the stand-by state is convenient. When the thick sheets or coated paper is used, waiting for 3 min. Is enough to restore the operable state.

Other selections are possible by the users to their good advantages.

In the foregoing example, the switch for setting the stand-by operation of the fixing device II is manually set by the operator, but it is a possible alternative to provide a controller to automatically switch the mode after a predetermined time elapses from completion of the image formation.

More particularly, when the image forming apparatus is not operated even after 15 min. Has elapsed from the completion of the image formation as shown in FIG. 4, the target temperature of the fixing device II is automatically switched from 180° C. to 100° C. When the image forming apparatus is not operated even after further 30 min. Elapses, the electric power supply to the fixing device II is automatically shut off.

Figure 5:
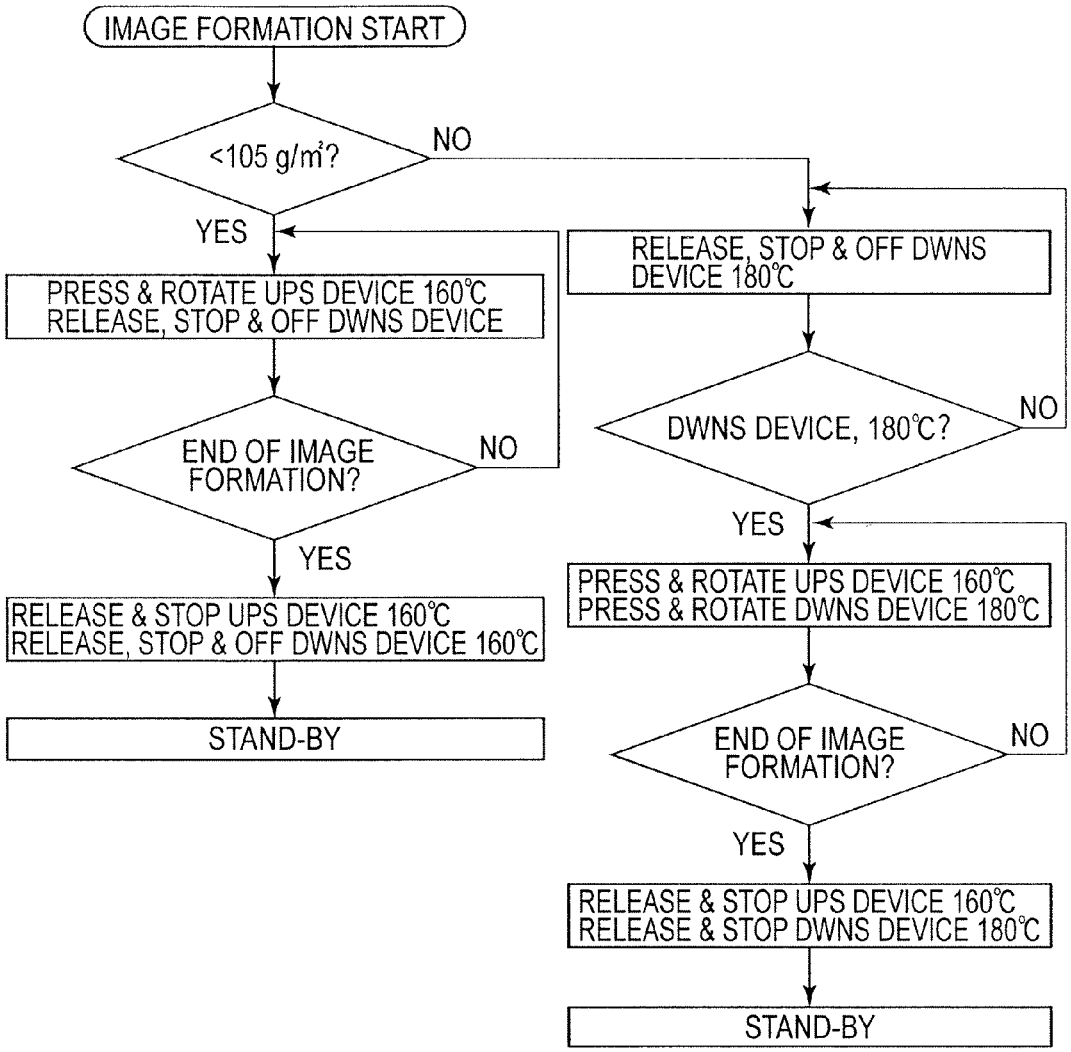
FIG. 5 is a flow chart illustrating a control sequence corresponding to a kind of the recording material.

The description will be made as to the fixing device operation starting when the target temperature of the fixing device II is 100° C. or the power supply thereto is shut off. Here, the case of the electric power supply to the fixing device II is shut off is taken for instance, referring to FIG. 5.

When the recording material to use has a basis weight less than 105 g/m$^2$, the state of the fixing device II is kept the same, and only the fixing device I is used.

When the recording material has a basis weight not less than 105 g/m$^2$ (thick paper) or the recording material is coated paper, the target temperature of the fixing device II is changed to 180° C. automatically upon discrimination of such a kind by the image forming apparatus.

The user may manually change the target temperature of the fixing device II, and the image forming operation is started upon confirmation of 180° C. of the temperature of the fixing device II.

Here, the description has been made as to the case in which after the predetermined time elapses from the completion of the image formation, the stand-by temperature of the fixing device II only (the temperature when the fixing device II is not used) is lowered automatically or manually. However, the stand-by temperature of the fixing device I may be simultaneously changed.

More particularly, as shown in Table 1, when 30 min. Elapses from the completion of the image forming operation, the target temperature of the fixing device I is changed from 160° C. to 90° C., and when 45 min. Elapsed, the electric power supply thereto is shut off. Thus, the timing at which the stand-by temperature of the fixing device I which is used in any image formation mode is lowered, is after the timing at which the stand-by temperature of the fixing device II which is used only in a part of the image formation modes. By such setting, the period in which the time from the input of the image formation instructions to the image forming apparatus to the actual start of the image formation is expanded, can be deviated. It is preferable that timing of switching the stand-by temperature (the time from the completion of the image formation to the switching of the stand-by temperature) can be selectable by the operator on the operating portion.

TABLE 1

| time after completion of image forming operation (minute) | temp. of upstrm fixing device (deg. C.) | temp. of dwnstrm fixing device (deg. C.) |
|---|---|---|
| -15 | 160 | 180 |
| 15-30 | 160 | 100 |
| 30-45 | 90 | off |
| 45- | off | off |

In the foregoing, substantially the same fixing devices are used in the image forming apparatus, but two fixing devices of different types are usable, or three or more fixing devices may be used.

As described in the foregoing, according to the embodiments of the present invention, when a plurality of fixing devices are used, the electric power consumed by the fixing device which is less frequently used is reduced.

Figure 6:
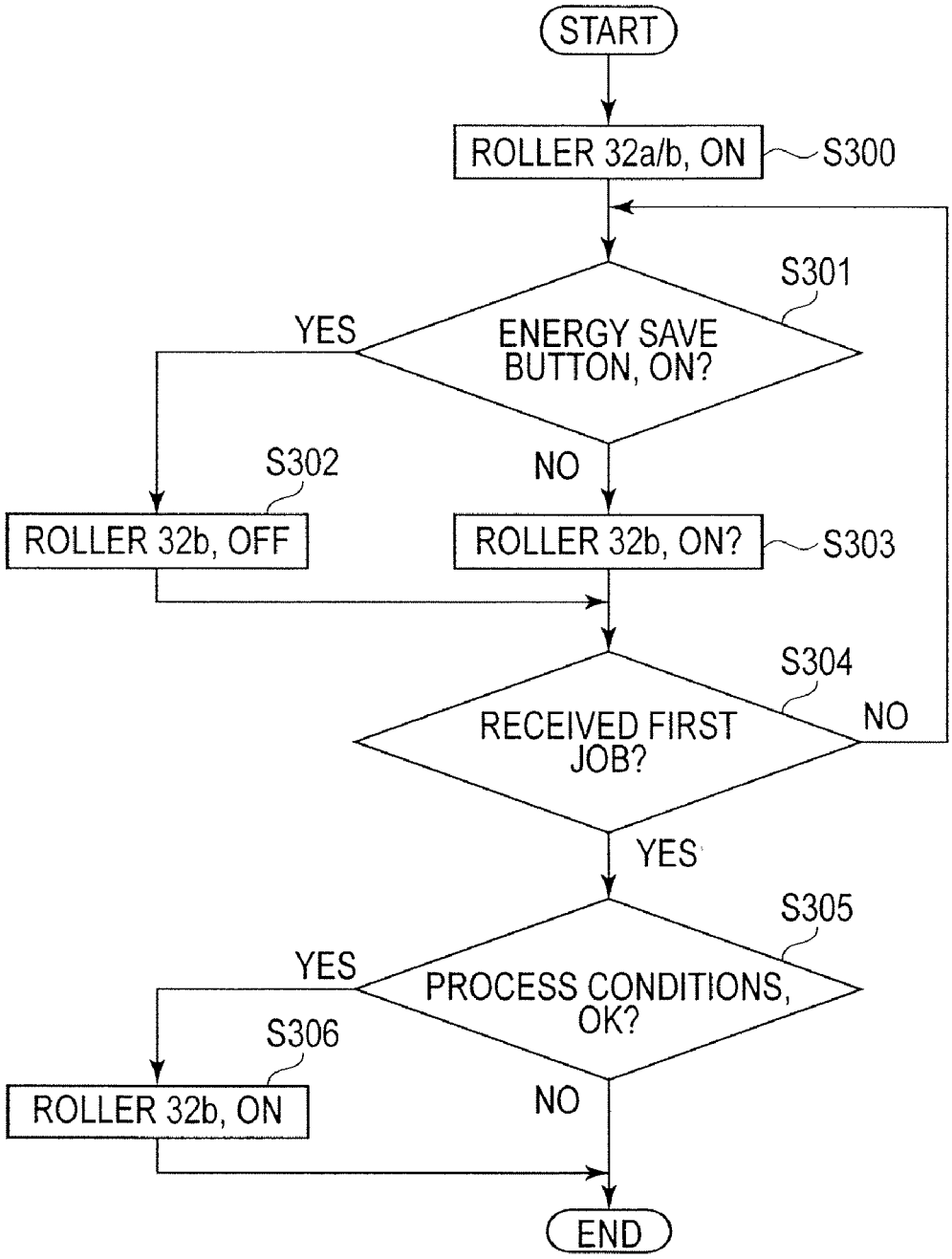
FIG. 6 is a flow chart of control when an energy conservation key is depressed.
Figure 7:
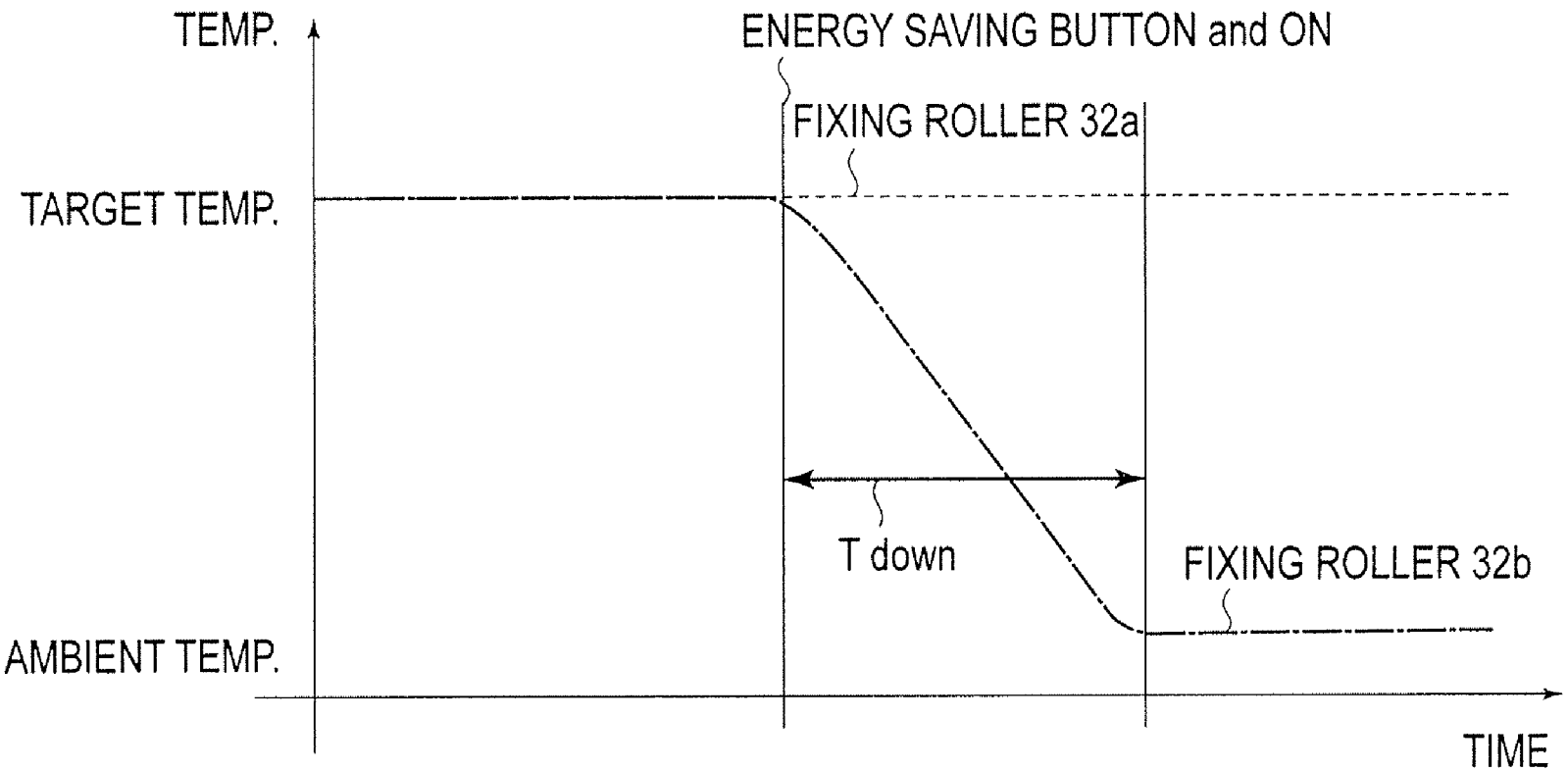
FIG. 7 shows control operations in chronological order.

Referring to FIGS. 6 and 7, the description will be made as to the control for the fixing rollers 32*a/b* when the user depresses the copying operation start key in the operating portion 219 in the period from the actuation of the main switch 216 to immediately before the image forming operation.

FIG. 6 is a flow chart of the control when the energy saving key is depressed in the operating portion 219. FIG. 7 shows the control operations with time. The ordinate represents the fixing temperature, and the abscissa represents the time.

The fixing heaters of the fixing rollers 32*a/b* are supplied with the electric power (S300) to keep the target temperature.

When user depressed the energy saving key on the operating portion 219, the electric power supply to the heater to the fixing roller 32*b* of the fixing device II is stopped (S302). As shown in FIG. 7, the temperature of the fixing roller 32*b* is lowered to a temperature substantially equivalent to the ambient temperature in the apparatus after Tdownhour.

When, on the contrary, the energy saving key is released by the user (S301), the electric power supply to the heater of the fixing roller 32*b* starts (S303). In the case that electric power supply to the heater of the fixing roller 32*b* has been started, nothing is done.

The controller 200 discriminates as to whether or not it accepts a first job (image formation job) produced by depression of the copying operation start key by the user.

The discrimination at step S304 is that controller 200 does not accept the first job, the operation returns to step S301, and similar operation is repeated (polling).

The discrimination at step S304 is that controller 200 accept the first job, it is discriminated whether or not the conditions of the process satisfy at least one of predetermined conditions (S305). The contents of the discrimination at the step S305 will be described hereinafter.

If the discrimination at the step S305 is negative, the state of the image forming apparatus is shifted to the in-operation mode.

If, on the contrary, the discrimination is affirmative, the electric power supply to the heater of the fixing roller 32*b* is started (S306). If the electric power supply has already been started, nothing is done.

Figure 8:
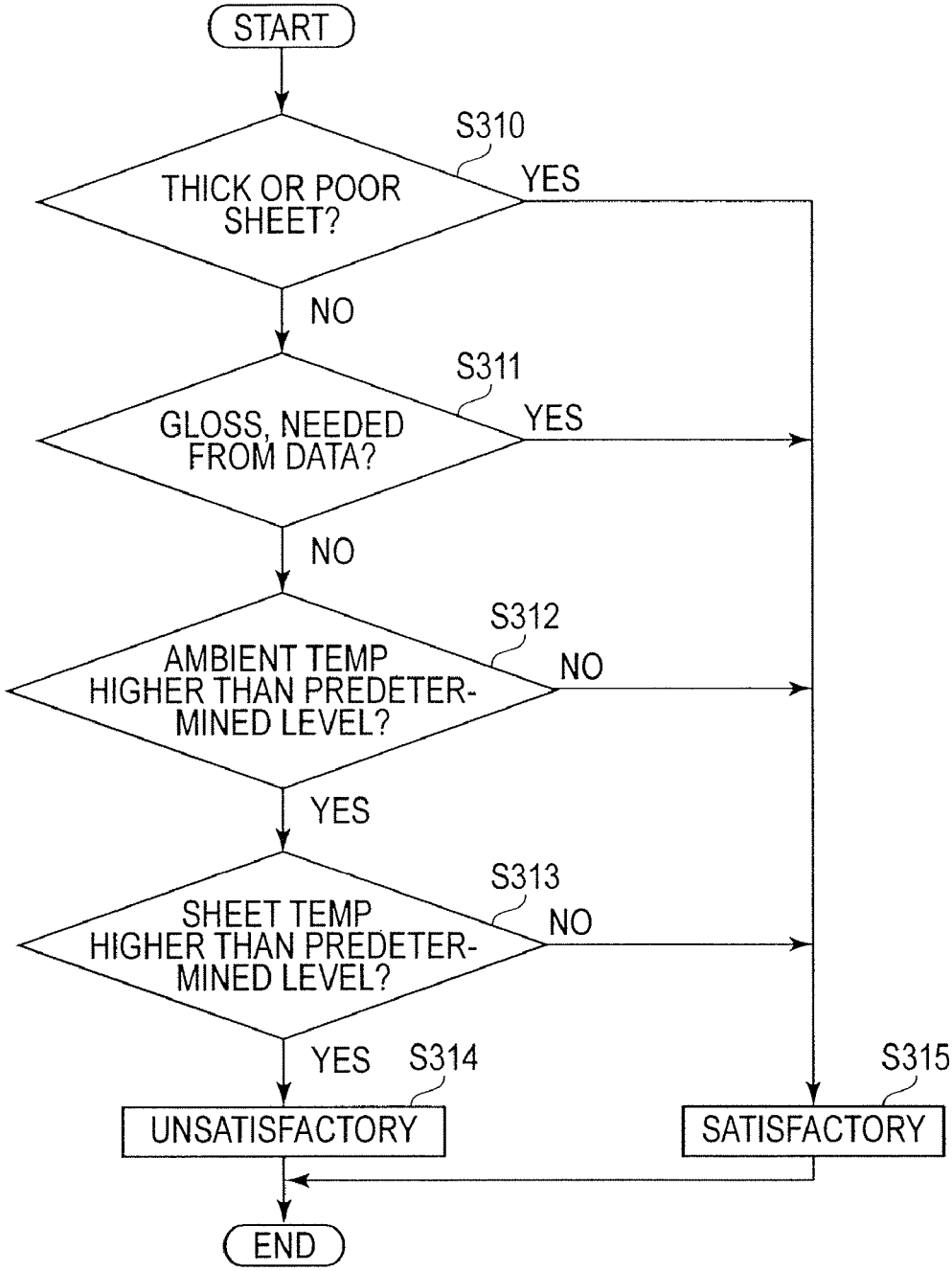
FIG. 8 show a comparison flow chart between various process conditions and predetermined conditions.

Referring to the flow chart of FIG. 8, the description will be made as to the comparison between the various conditions of the process and the predetermined condition for the purpose of discrimination as to whether or not the electric power supply to the heater of the fixing roller 32*b* at S305 is to be started.

At step S310, if the discrimination indicates that recording material used is a thick sheet or poor paper, the condition is deem as being met (S315), and the comparing operation ends.

The detection of the kind of the recording material may be made on the basis of the setting in the operating portion 219 by the user or may be automatically made by a sensor such as a photo-interruptor.

In the case of the thick paper or poor paper, the heat is absorbed by the sheet when it passes through the fixing roller 32*a*, with the possible result of insufficient fixing property. Therefore, in the case of the thick sheet or poor paper, it is preferably passed through fixing device having the fixing roller 32*b* to assure the fixing property.

When the controller 200 discriminates at step S311 that formation of high glossiness image is necessary on the basis of the image data, the condition is deemed as being met (S315), and the comparison sequence ends.

A ratio of the image data and the letter data of the image data stored in the image memory is detected by image area separation or the like, and if the ratio of the image data is high, it is discriminated that formation of the high glossiness image is necessary. Alternatively, the user can set at the operating portion 219. The fixing property is satisfied by passing the upstream fixing device having the fixing roller 32*a*, but by passing the downstream fixing device having the fixing roller 32*b*, a high glossiness can be provided.

Therefore, it is preferable that necessity of the glossiness enhancement is discriminated.

When the discrimination by the controller 200 at step S312 indicates that ambient temperature exceeds a predetermined temperature, the condition is deemed as being met (S315), and the comparison sequence ends.

A high ambient temperature means high fixing property on the recording material, and therefore, the fixing operation by the fixing device having the fixing roller 32*b* is not required. The predetermined temperature can be properly selected by one skilled in the art. Therefore, the discrimination as to whether or not the ambient temperature exceeds the predetermined temperature is preferable.

When the discrimination at the step S313 indicates that temperature of the recording material does not exceeds a predetermined temperature, the condition is deemed as being satisfied (S315), and the comparison sequence ends.

A high temperature of the recording material means high fixing property on the recording material, and therefore, the fixing operation by the fixing device having the fixing roller 32*b* is not required. The predetermined temperature can be selected properly by one skilled in the art. Therefore, it is preferable that discrimination is made as to whether or not the temperature of the recording material exceeds the predetermined temperature.

Here, the temperature of the recording material is detected, but this may be replaced with the discrimination as to whether or not the both sides image forming operation is carried out. This is because in the case of the both sides operation, the temperature of the recording material is high if the recording material has passed through the fixing device having the fixing roller 32*a* in the first side image formation. In the case that both sides image forming operation is not carried out, the condition is deemed as being satisfied (S315), and the comparison sequence ends.

If the condition is not satisfied as a result of the above-described comparison (S314), the comparison sequence ends.

Figure 9:
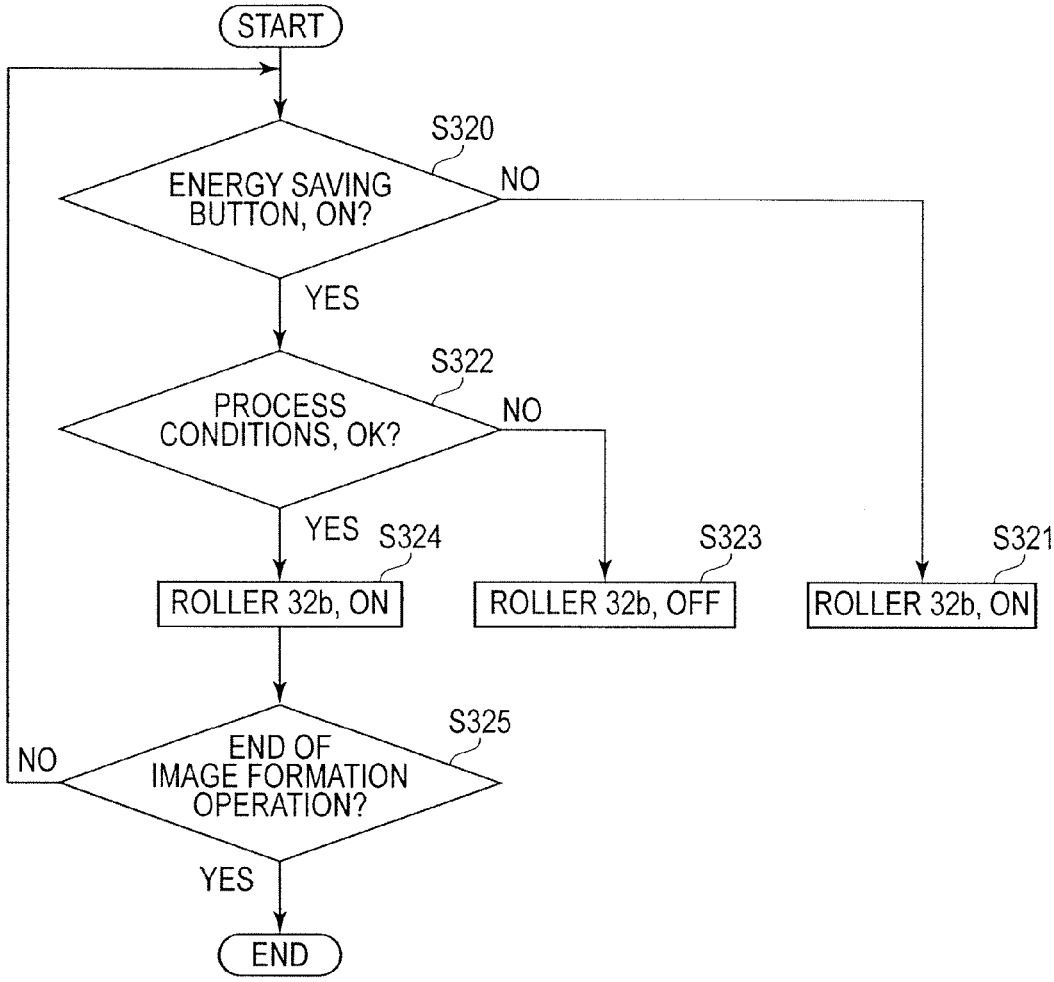
FIG. 9 illustrates a control when the energy conservation key is depressed.

Referring to the flow chart of FIG. 9, the description will be made as to the control when the energy saving key in the operating portion 219 is depressed by the user during the image formation.

First, the controller 200 discriminates whether or not the energy saving key is depressed in the operating portion 219 during the image formation (S320).

If the result of the discrimination at the step S320 is negative, the electric power supply to the heater of the fixing roller 32*b* starts (S321).

If the electric power supply has already been started, nothing is done here. If the result of the discrimination at the step S320 is affirmative, it is discriminated whether or not the conditions of the process satisfy at least one of predetermined conditions (S322). The content of the discrimination at S322 are the same as the foregoing.

If the predetermined condition is not met as a result of the discriminations of the controller 200 (S322), the electric power supply to the heater of the fixing roller 32*b* is stopped (S323). If the electric power supply has already been stopped, nothing is done.

If the predetermined condition is met at step S322, the electric power supply to the heater of the fixing roller 32*b* is started (S323). If the electric power supply has already been started, nothing is done.

Then, the controller 200 discriminations whether or not the image forming operation is finished (S325).

If the result of the discrimination at the step S325 is affirmative, the operation returns to the step S301 of FIG. 6 (Embodiment 2), the sequence for the time from the actuation of the main switch to immediately before the image forming operation is carried out.

If the result of the discrimination at the step S325 is negative, the operation returns to the step S320, and the similar operation is carried out (polling).

Embodiment 2

Figure 10:
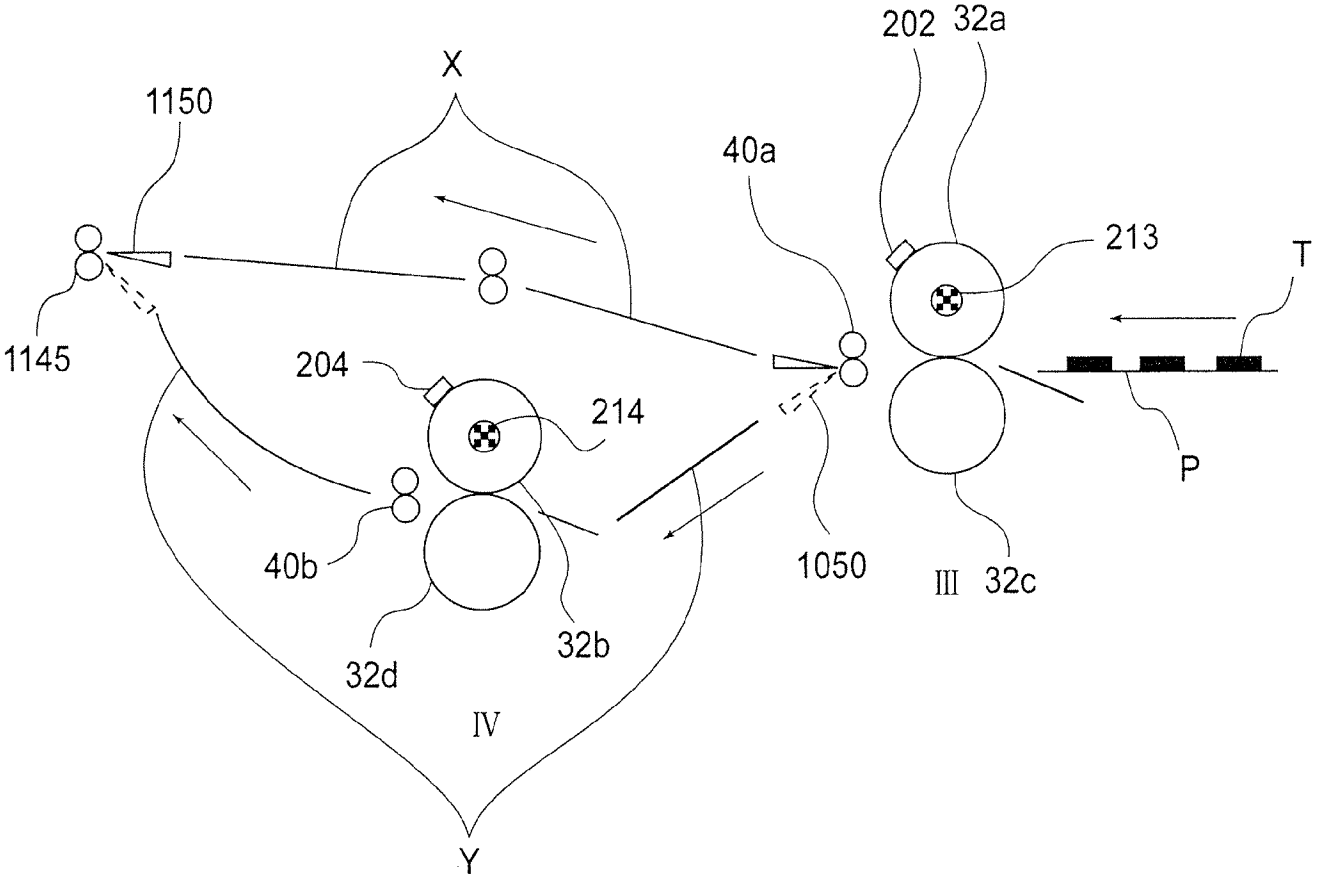
FIG. 10 is a sectional view of a fixing device.

FIG. 10 is a schematic view of an example of a fixing device used in the image forming apparatus according to an embodiment of the present invention. A fixing device III is the same as the foregoing fixing device I, and a fixing device IV is the same as the foregoing fixing device II, and therefore, the detailed description therefor is omitted for simplicity.

In this embodiment, there are provided two recording material feeding paths after the fixing device III.

More particularly, after the fixing device III, the recording material passes through the pair of the feeding rollers 40*a*, the recording material is guided to either one of the two feeding paths by the feeding path switching guide 1050. The feeding path switching guide is controlled by a controller 200.

In the case that recording material has a basis weight of less than 105 g/m$^2$, similarly to Embodiment 1, the fixing operation is carried out only by the fixing device III. To do this, the feeding path switching guide 1050 moves to guide the recording material to the bypass path to avoid the fixing device. Then, the recording material is passed through the feeding path X, and is fed to the sheet discharging roller 1145, and then, is discharged by the sheet discharging rollers 1145.

On the other hand, if the recording material has a basis weight not less than 105 g/m$^2$, or it is coated paper, two fixing devices are used. After the recording material is subjected to the fixing operation in the fixing device III, it passes through the pair of the sheet discharging rollers 40*a*, and then, is immediately guided to the fixing device feeding path Y by the feeding path switching guide 1050. The recording material is subjected to the fixing operation by the fixing device IV, the recording material is guided toward the sheet discharging rollers 1145 by the feeding path switching guide 1150, and then, is discharged by the sheet discharging roller 1145.

Similarly to the foregoing embodiment, the number of the fixing devices is changed in accordance with the kind of the recording material to be used. The same applies to the structure for manually or automatically setting the target temperature of the fixing device IV, and therefore, the description thereof is omitted for simplicity.

In Embodiment 1, when the fixing device II is not used, the fixing roller 32*b* and the pressing roller 32*d* of the fixing device II are spaced from each other, and the recording material P is passed through therebetween. In this embodiment, in the case that image is fixed without use of the fixing device IV, the recording material is fed along the recording material feeding path X exclusively for that case, and therefore, the recording material can be stably fed. For example, it can be avoided that image surface immediately after the fixing operation by the fixing device III, is contacted to a fixing member of the fixing device IV with the result of an image defect. In addition, even if curling occurs in the recording material immediately after the fixing operation by the fixing device III, the recording material can be fed stably. In addition, the by-pass path may be utilized for one or more of various controls such as inclination correction of the recording material feeding, curl rectification and the like.

In this embodiment, the fixing device IV is disposed below the by-pass path, but they may be reverted.

As described in the foregoing, according to the embodiments of the present invention, the operating condition of the fixing device which is used less frequently, can be set by the user, the usability is improved.

As a result, the electric power consumed by the fixing device which is less frequently used can be saved, and the lifetime of fixing device can be improved, correspondingly.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 309554/2004 filed Oct. 25, 2004 which is hereby incorporated by reference.

What is claimed is:

1. A image forming system comprising:

a image forming device for forming a toner image on a recording material;

a first image heating device for heating the toner image on the recording material at a first nip, said first image heating device being heated by a first heater so as to maintain a target temperature;

a second image heating device for heating the toner image on the recording material, which has been heated by said first image heating device, at a second nip provided at a position is different from the first nip, said second image heating device being heated by a second heater so as to maintain a target temperature;

a selecting device for selecting one of image forming modes including a first image forming mode in which only said first image heating device is used for a image heating process and a second image forming mode in which said first image heating device and said second image heating device are used for the image heating process; and a delaying device for making timing at which the target temperature of said first image heating device is lowered in a stand by state later than a timing at which the target temperature of said second image heating device is lowered in the stand by state.

2. A system according to claim 1, wherein said delaying device delays timing at which a electric power supply to said first image heating device is stopped in the stand by state later than timing at which a electric power supply to said second image heating device is stopped in the stand by state.

3. A system according to claim 1, wherein said selecting device selects the one of image forming modes based on a type of the recording material.

4. A system according to claim 1, further comprising a first feeding path for passing the recording material through only said first image heating device for the image heating process and a second feeding path for passing the recording material through said first image heating device and said second image heating device for the image heating process.

* * * * *

UNITED STATES PATENT AND TRADEMARK OFFICE

CERTIFICATE OF CORRECTION

PATENT NO. : 7,412,182 B2
APPLICATION NO. : 12/014315
DATED : August 12, 2008
INVENTOR(S) : Hayashi et al.

It is certified that error appears in the above-identified patent and that said Letters Patent is hereby corrected as shown below:

TITLE PAGE:
At Item (57), Abstract, Line 7, “for a” should read --for an--.
At Item (57), Abstract, Line 13, “Stand” should read --stand--.

COLUMN 1:
Line 19, “using” should read --use--.
Line 32, “an” should read --a--.

COLUMN 2:
Line 20, “following” should read --following.--.

COLUMN 3:
Line 48, “roller” should read --rollers--.

COLUMN 4:
Line 27, “roller” should read --rollers--.

COLUMN 5:
Line 11, “like” should read --like;--.
Line 12, “a” should be deleted, and “liquid” should read --a liquid--.
Line 35, “fixing rollers 32a 32b” should read --fixing rollers 32a, 32b,--.
Line 36, “is” should read --are--.

COLUMN 6:
Line 10, “is” should read --are--.

COLUMN 7:
Line 24, “180°C.” should read --be 180°C.--.
Line 34, “In” should read --in--.
Line 35, “In” should read --in--.
Line 46, “the” should read --to the--.
Line 53, “are” should read --is--.

COLUMN 8:
Line 1, “To” should read --to--.
Line 2, “At” should read --at--.
Line 4, “king” should read --fixing--.
Line 16, “Is” should read --is--.

UNITED STATES PATENT AND TRADEMARK OFFICE

CERTIFICATE OF CORRECTION

PATENT NO. : 7,412,182 B2
APPLICATION NO. : 12/014315
DATED : August 12, 2008
INVENTOR(S) : Hayashi et al.

It is certified that error appears in the above-identified patent and that said Letters Patent is hereby corrected as shown below:

COLUMN 8:
Line 26, “Has” should read --has--.
Line 30, “Elapses,” should read --elapses,--.
Line 36, “instance,” should read --granted,--.
Line 57, “Elapses” should read --elapses,--.

COLUMN 9:
Line 10, “(minute)” should read --(minutes)--.
Line 35, “user depressed” should read --the user depresses--.
Line 49, “controller 200” should read --if the controller 200--.
Line 52, “controller 200” should read --if the controller 200--.
Line 53, “accept” should read --accepts--.
Line 54, “predetermined” should read --the predetermined--.

Column 10:
Line 6, “deem” should read --deemed--.
Line 15, “through” should read --through the--.
Line 44, “exceeds” should read --exceed--.
Line 57, “sides” should read --sides of the--.

COLUMN 11:
Line 14, “predetermined” should read --the predetermined--.
Line 18, “discriminations” should read --discrimination--.
Line 26, “discriminations” should read --discriminates--.

COLUMN 12:
Line 19, “fixing device III,” should read --fixing device III--.
Line 35, “fixing device” should read --the fixing device--.
Line 48, “A image forming” should read --An image forming--.
Line 49, “a image forming device” should read --an image forming device--.
Line 58, “position is different” should read --position different--.

UNITED STATES PATENT AND TRADEMARK OFFICE

CERTIFICATE OF CORRECTION

PATENT NO. : 7,412,182 B2
APPLICATION NO. : 12/014315
DATED : August 12, 2008
INVENTOR(S) : Hayashi et al.

It is certified that error appears in the above-identified patent and that said Letters Patent is hereby corrected as shown below:

COLUMN 13:
Line 3, “a stand by” should read --a standby--.
Line 5, “stand by” should read --standby--.
Line 7, “a electric” should read --electric--.
Line 8, “stand by” should read --standby--.
Line 9, “a electric” should read --electric--.
Line 10, “stand by” should read --standby--.

Signed and Sealed this

Sixth Day of January, 2009

JON W. DUDAS
*Director of the United States Patent and Trademark Office*